US010458767B2

(12) United States Patent
Buchanan

(10) Patent No.: US 10,458,767 B2
(45) **Date of Patent: *Oct. 29, 2019**

(54) ARROWHEAD

(71) Applicant: CENTERCROSSARCHERY LLC, Burnsville, NC (US)

(72) Inventor: Howard Andrew Buchanan, Burnsville, NC (US)

(73) Assignee: Center Cross Archery

( * ) Notice: Subject to any disclaimer, the term of this patent is extended or adjusted under 35 U.S.C. 154(b) by 0 days.

This patent is subject to a terminal disclaimer.

(21) Appl. No.: 15/932,814

(22) PCT Filed: Nov. 4, 2016

(86) PCT No.: PCT/US2016/000092

§ 371 (c)(1),
(2) Date: Apr. 30, 2018

(87) PCT Pub. No.: WO2017/078748

PCT Pub. Date: May 11, 2017

(65) Prior Publication Data

US 2018/0292190 A1 Oct. 11, 2018

Related U.S. Application Data

(60) Provisional application No. 62/392,245, filed on May 24, 2016, provisional application No. 62/389,059, filed on Feb. 16, 2016, provisional application No. 62/285,679, filed on Nov. 5, 2015.

(51) Int. Cl.
*F42B 6/08* (2006.01)
*F42B 12/34* (2006.01)

(52) U.S. Cl.
CPC ..... *F42B 12/34* (2013.01); *F42B 6/08* (2013.01)

(58) Field of Classification Search
CPC ..... F42B 6/08
See application file for complete search history.

(56) References Cited

U.S. PATENT DOCUMENTS 2,859,970 A * 11/1958 Doonan ..... F42B 6/08 43/6
4,504,063 A * 3/1985 LeBus ..... F42B 6/08 473/584
4,932,671 A * 6/1990 Anderson, Jr. ..... F42B 6/08 473/583
4,998,738 A * 3/1991 Puckett ..... F42B 6/08 473/583

(Continued)

FOREIGN PATENT DOCUMENTS

WO WO 2014/099990 A1 6/2014

OTHER PUBLICATIONS

Written Opinion of the International Searching Authority for PCT/US2016/000092.

*Primary Examiner* — John A Ricci
(74) *Attorney, Agent, or Firm* — Timothy Stevens; Karen Kimble

(57) ABSTRACT

A broadhead arrowhead having retractable blades wherein a plunger of the tip of the arrowhead causes the blades to shear a shear pin and deploy when the arrowhead strikes a target. In an alternative embodiment, the blades are retained in the arrowhead by a friction fit that is overcome to deploy the blades when the arrowhead strikes a target.

7 Claims, 8 Drawing Sheets

(56) References Cited

U.S. PATENT DOCUMENTS

| | | | | |
|---|---|---|---|---|
| 5,102,147 | A * | 4/1992 | Szeluga | F42B 6/08 473/584 |
| 5,112,063 | A * | 5/1992 | Puckett | F42B 6/08 473/583 |
| 5,458,341 | A * | 10/1995 | Forrest | F42B 6/08 473/583 |
| 7,713,152 | B1 * | 5/2010 | Tentler | F42B 6/08 473/583 |
| 7,905,802 | B2 * | 3/2011 | Erhard | F42B 6/08 473/583 |
| 8,118,694 | B1 * | 2/2012 | Oliveira | F42B 6/08 473/583 |
| 8,905,874 | B2 * | 12/2014 | Sullivan | F42B 12/34 473/583 |
| 9,683,819 | B2 | 6/2017 | Buchanan | |
| 2007/0161438 | A1 | 7/2007 | Fulton | |
| 2008/0102996 | A1 | 5/2008 | Erhard | |
| 2012/0040787 | A1 | 2/2012 | Ulmer | |
| 2012/0220400 | A1 | 8/2012 | Pulkrabek et al. | |
| 2015/0184986 | A1 * | 7/2015 | Franco, Sr. | F42B 6/08 473/577 |

* cited by examiner

ARROWHEAD

BACKGROUND OF THE INVENTION

The instant invention relates to broadhead arrowheads of the type that comprise expanding blades. The art terms such broadhead arrowheads as "mechanical broadheads". Broadhead arrowheads are known and comprise either fixed or expandable blades. Fixed blade broadheads are mechanically simple but suffer from relatively high aerodynamic drag from the exposed fixed blades. Fixed blade broadheads also require care in handling and storage to prevent blade dulling and accidental injury to the hunter. The blades of many expandable blade broadheads do not fully retract into the body of the arrowhead and thus suffer from the same aerodynamic drag and safety problems as fixed blade broadheads.

U.S. Pat. Nos. 4,998,738 and 5,112,063 disclose tip actuated expanding blade arrowheads. The term "tip actuated expanding blade arrowhead" used in this disclosure means a mechanical broadyead wherein the blades swing from the arrowhead by the action of the tip being forced into the arrowhead when the arrowhead strikes a game animal. As discussed in U.S. Pat. Nos. 4,998,738 and 5,112,063, the objective for any hunting arrow with deployable cutting blades is to have the blades retracted to a more aerodynamic position during the flight of the arrow and to have the blades open to a cutting position which causes maximum hemorrhaging when the arrow strikes its quarry. As discussed above, traditional broadheads have fixed, exposed cutting blades which are subject to wind drag and other adverse wind effects during the flight of the arrow. It has been found that broadheads designed with deployable blades overcome the problems associated with wind effects and are more accurate than traditional fixed blade broadheads.

U.S. Pat. No. 2,859,970 discloses a cone which houses a pair of cutting blades therein where the cutting blades are mounted on a pivot pin. The Doonan device is frictionally fit over the tip of a target arrow. The intended design of the Doonan device is such that during the flight of the arrow, the cutting blades stay within the cone, thereby overcoming adverse wind effects on the flight of the arrow. When the cone strikes the animal, the arrow shaft rams the target tip into the back of the cutting blades such that they open up from the cone by pivoting on the pivot pin. One problem with the Doonan device is that the shaft of the arrow is likely to ram the cutting blades of the cone open just as the arrow is shot because of the inertia of the cone relative to the speed of the arrow. Another problem with the Doonan device is that the frictional engagement of the cutting blades against sidewalls of slots in the cone is not easily controllable.

U.S. Pat. No. 4,932,671 shows a phantom bladed broadhead where the cutting blades remain inside a cylindrical ferrule body during flight and are rammed open by a plunger, positioned to slide rearward from the front of the body, when the plunger impacts against the body of the animal. In Anderson, the cutting blades are not connected to the plunger but are pivotally connected to the cylindrical body by a ring which passes through a forward cut out section of each blade.

U.S. Pat. No. 4,504,063 discloses a broadhead which is designed to have a slimmer profile during flight and a wider, cutting profile upon impact. In LeBus, a plunger, which extends from the front of the broadhead while it is in flight, includes a weight at its rear section that acts against notches formed on the inside surfaces of the cutting blades when the broadhead strikes an animal. LeBus utilizes an O-ring to help hold the cutting blades in their slimmer profile during flight wherein the O-ring fits in a notched portion at the base of each cutting blade and the O-ring expands when the weight at the rear of the plunger forces the cutting blades open. Since the blades of the LeBus broadhead are always slightly open, the archer must be very careful when installing the O-ring so as not to get cut on the sharp blades of the broadhead.

U.S. Pat. Nos. 5,102,147 and 8,118,694 disclose other broadheads having fully retracting blades. U.S. Pat. Nos. 7,713,152; 7,905,802; 8,905,874; and US Patent Application Publication 2015/0184986 disclose broadheads having partially retracting blades. Despite the above-mentioned advancements in the art of mechanical broadheads, there remains a need for a mechanical broadhead having a better balance of aerodynamic, reliability, adaptability, versatility and ruggedness factors.

SUMMARY OF THE INVENTION

The instant invention is an important advance in the art of expanding blade arrowheads. The instant invention is a mechanical broadhead system that provides a better balance of aerodynamic, reliability, adaptability, versatility and ruggedness factors than mechanical broadheads of the prior art. In one embodiment, the instant invention is a method for expanding the blade of a tip actuated expanding blade arrowhead, the arrowhead comprising a cylindrical ferrule, a tip, at least one blade, a hinge pin; the ferrule having a longitudinal axis, the ferrule having a passageway thereinto along the longitudinal axis of the ferrule, the tip having a shank dimensioned to pass into the passageway, the ferrule having an elongated aperture into said passageway on one side of the ferrule into which the at least one blade is positioned in the ferrule, the at least one blade having a first aperture near one end so that when the arrowhead strikes a game animal the shank of the tip is forced into the ferrule in a direction along the longitudinal axis of the ferrule to force the at least one blade to swing out from the ferrule on the hinge pin, the method characterized by positioning a shear pin through a bore in the ferrule and through a second aperture near the other end of the at least one blade, the axis of the bore being transverse to the longitudinal axis of the passageway into the ferrule, so that the at least one blade is retained in the ferrule before the arrowhead strikes a game animal but that when the arrowhead strikes a game animal the shank of the tip is forced into the ferrule in a direction along the longitudinal axis of the passageway of the ferrule to force the at least one blade to swing out from the ferrule on the hinge pin to shear the shear pin.

In another embodiment the instant invention is an arrowhead comprising: (a) a cylindrical ferrule; (b) a tip; (c) a first blade; (d) a second blade; (e) a hinge pin; and (d) a shear pin, the ferrule having a longitudinal axis, the ferrule having a passageway thereinto along the longitudinal axis of the ferrule, the tip having a shank dimensioned to pass into the passageway, the ferrule having a first elongated aperture into said passageway on one side of the ferrule into which the first blade is positioned, the ferrule having a second elongated aperture into said passageway on the other side of the ferrule into which the second blade is positioned, the first blade having a first aperture near one end and a second aperture near the other end, the second blade having a first aperture near one end and a second aperture near the other end, the hinge pin positioned through the first aperture of the first and second blades, the hinge pin positioned near the shank of the tip, the ferrule having a bore therethrough transverse to the longitudinal axis of the ferrule, the shear pin positioned through said bore and through the second apertures of the first and second blades so that when the arrowhead strikes a game animal the shank of the tip pushes the hinge pin and blades to move in a direction along the longitudinal axis of the ferrule away from the tip to shear the shear pin so that the blades swing out from the ferrule on the hinge pin.

In yet another embodiment, the instant invention is an arrowhead comprising: (a) a cylindrical ferrule; (b) a tip; (c) a first blade; (d) a second blade; and (e) a hinge pin, the ferrule having a longitudinal axis, the ferrule having a passageway thereinto along the longitudinal axis of the ferrule, the tip having a shank dimensioned to pass into the passageway, the ferrule having a first elongated aperture into said passageway on one side of the ferrule into which the first blade is positioned within the ferrule, the ferrule having a second elongated aperture into said passageway on the other side of the ferrule into which the second blade is positioned within the ferrule, the first blade having a first aperture near one end and a detent projection near the other end, the first blade detent projection being an interference fit in the first elongated aperture, the second blade having a first aperture near one end and a detent projection near the other end, the second blade detent projection being an interference fit in the second elongated aperture, the hinge pin positioned through the first aperture of the first and second blades, the hinge pin positioned near the shank of the tip so that when the arrowhead strikes a game animal the shank of the tip pushes the hinge pin and blades to move in a direction along the longitudinal axis of the ferrule away from the tip so that the blades swing out from the ferrule on the hinge pin.

In still another embodiment, the instant invention is an arrowhead comprising: (a) a cylindrical ferrule; (b) a tip; (c) a first blade; (d) a second blade; (e) a hinge pin; and (d) a shear pin, the ferrule having a longitudinal axis, the ferrule having a passageway thereinto along the longitudinal axis of the ferrule, the tip having a shank dimensioned to pass into the passageway, the ferrule having a first elongated aperture into said passageway on one side of the ferrule into which the first blade is positioned within the ferrule, the ferrule having a second elongated aperture into said passageway on the other side of the ferrule into which the second blade is positioned within the ferrule, the first blade having a first aperture near one end and a second aperture near the other end, the second blade having a first aperture near one end and a second aperture near the other end, the hinge pin positioned through the first aperture of the first and second blades, the hinge pin positioned through and transverse to the longitudinal axis of the ferrule, the ferrule having a bore therethrough transverse to the longitudinal axis of the ferrule, the shear pin positioned through said bore and through the second apertures of the first and second blades so that when the arrowhead strikes a game animal the shank of the tip pushes the blades to move in a direction away from the longitudinal axis of the ferrule to shear the shear pin and swing out from the ferrule on the hinge pin In yet another embodiment, the instant invention is a kit of parts packaged for retail sale, comprising: an arrowhead of the instant invention employing a shear pin made of an elastomer; and (b) a plurality of shear pins colored coded to correspond to the durometer value of the shear pin.

DETAILED DESCRIPTION OF THE INVENTION

Figure 1:
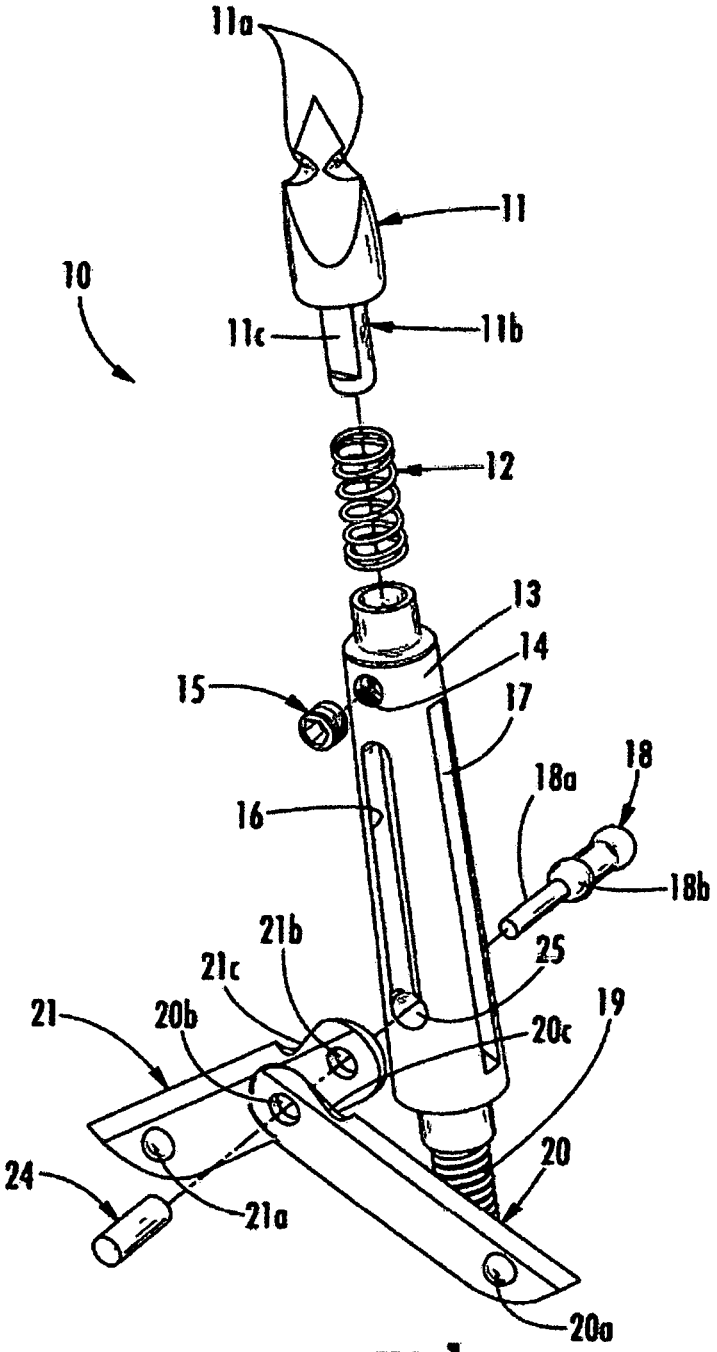
FIG. 1 is an exploded view of the parts of a highly preferred embodiment of the instant invention.

Referring now to FIG. 1, therein is shown an exploded view of the parts of a highly preferred arrowhead 10 of the instant invention. Arrowhead 10 includes cylindrical ferrule 13, tip 11 and tip retraction spring 12. The term "cylindrical" is defined herein to include a conical shape. Tip 11 has the terminal shape of a three sided pyramid and is notched with notches 11*a*. Tip plunger 11*b* is passed through spring 12 into ferrule 13. Set screw 15 retains tip 11 in ferrule by engagement near tip plunger flat portion 11*c*. Blade 20 is inserted into elongated aperture 17 in ferrule 13. Blade 21 is inserted into an elongated aperture (not shown) opposite elongated aperture 17 in ferrule 13 so that pin 24 is passed through aperture 20*b* in blade 20 and aperture 21*b* in blade 21. Then pin 24 is slid up elongated aperture 16 in ferrule 13 so that shear pin 18 can be passed through an aperture (not shown) opposite aperture 25 in ferrule 13, through aperture 21*a* of blade 21, through aperture 20*a* of blade 20 and then through aperture 25 of ferrule 13 so that bulbous portion 18*b* of shear pin 18 is positioned in aperture 25 with shear pin tail 18*a* extending from ferrule 13. Threaded shank 19 permits arrowhead 10 to be screwed into the shaft of an arrow or into the shaft of a crossbow bolt. A preferred shear pin 18 of the instant invention has a central diameter of 2.63 millimeters and is molded of an elastomer having a durometer value selected to shear upon impact of the arrowhead with a target. The preferred shear pin durometer value for use with a compound bow is a value on the A scale of between 40 and 45. Since a crossbow typically has a higher bolt acceleration upon firing, the preferred shear pin durometer value for use with a crossbow is a value on the A scale of between 50 and 60.

Figure 2:
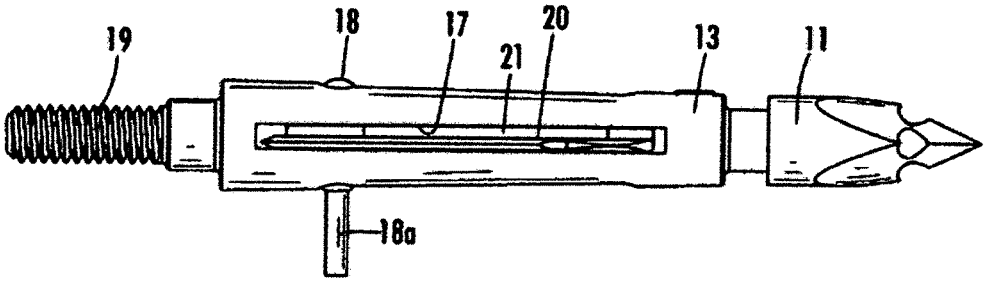
FIG. 2 is a side view of the assembled arrowhead of FIG. 1.

Referring now to FIG. 2, therein is shown a side view of an assembled arrowhead 10 with shear pin tail 18*a* shown extending from ferrule 13. Shear pin tail 18*a* is preferably removed before use of arrowhead 10. Blades 20 and 21 are positioned on top of each other and folded into body 13 as seen through elongated aperture 17 in ferrule 13.

Figure 3:
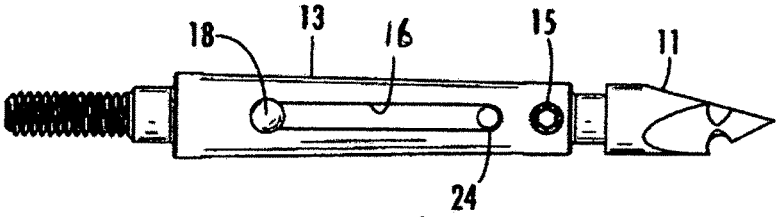
FIG. 3 depicts the arrowhead of FIG. 1 in flight.

Referring now to FIG. 3, tip 11 is shown in its extended position retained by set screw 15. Shear pin 18 retains the blades of the arrowhead within ferrule 13. Hinge pin 24 is shown at one end of elongated aperture 16. FIG. 3 shows arrowhead 10 of FIG. 1 in flight. Since the blades of the arrowhead are within ferrule 13, the arrowhead is more aerodynamic in flight than mechanical broadheads having blades that are exposed in flight.

Figure 4:
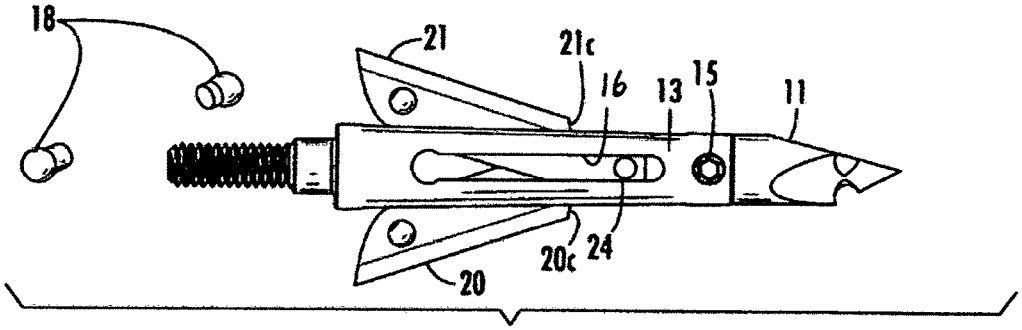
FIG. 4 depicts the arrowhead of FIG. 1 upon impact with a target.
Figure 5:
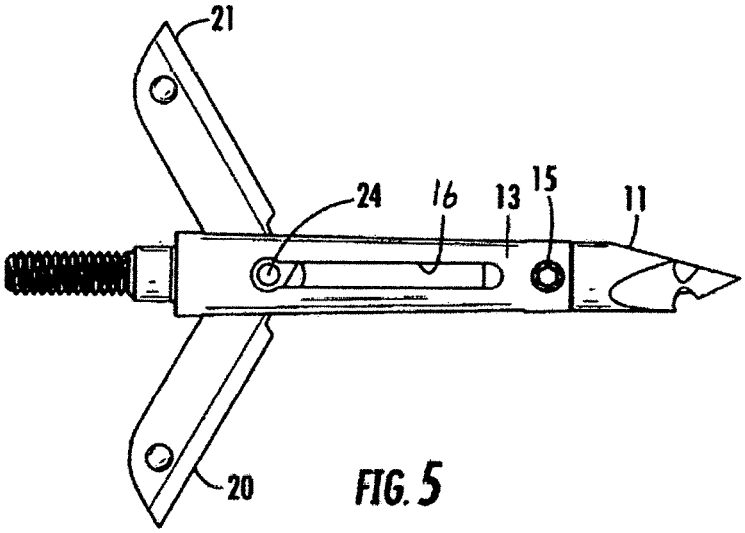
FIG. 5 depicts the blades of the arrowhead of FIG. 1 fully deployed after impact with the target.

Referring now to FIG. 4, when arrowhead 10 of FIG. 1 strikes a target game animal (such as a deer) tip plunger 11*b* is forced into ferrule 13 to force blades 20 and 21 from ferrule 13 shearing shear pin 18 as pin 24 is slid in the direction away from tip 11 along elongated aperture 16. Notch 20*c* in blade 20 and notch 21*c* in blade 21 tend to snag and engage with the target to better enable blade 20 and blade 21 to fully deploy as shown in FIG. 5. The reliability of the full extension of the blades of the arrowhead of the instant invention when the arrowhead strikes a game animal is an important benefit of the arrowhead of the instant invention. If the arrowhead of FIGS. 3-5 is fired into a foam or straw target block so that the arrowhead is buried in the target block, an important benefit of the instant invention is that the arrowhead can be withdrawn from the target block, the blades folding back into the ferrule as the arrow head is withdrawn from the target block. The same benefit is observed if the arrowhead is buried in the flesh of a game animal.

Referring again to FIG. 1, the spring constant of tip retraction spring 12 and shear strength of shear pin 18 are readily confirmed by experiment. For example, if the spring constant of tip retraction spring 12 and shear strength of shear pin 18 are too low, then blades 20 and 21 will deploy in the air upon firing of the arrowhead thereby increasing the aerodynamic drag of the arrowhead. And, if the spring constant of tip retraction spring 12 and the shear strength of shear pin 18 are too high, the blades will fail to deploy upon striking the target. High power crossbows typically require higher shear strength shear pins while longbows typically require lower shear strength shear pins. Notches 11*a* in tip 11 shown in FIG. 1 are highly preferred because the pointed edges thereof increase the initial force of the tip shank 11*b* into ferrule 13 when arrowhead 10 strikes a game animal. It should be understood that an arrow tip terminating in a pyramid point wherein the edges of the faces of the pyramid are notched with cylindrical notches transverse to the edges of the pyramid is novel and unobvious as a separate invention disclosed herein. It should also be understood that tip 11 shown in FIG. 1 is not critical in the instant invention and that any tip shape can be used in the instant invention. Preferably, the arrowhead 10 of FIG. 1 is sold in a package that includes spare color coded shear pins of different shear strength together with recommendations for use with different bows, compound bows and crossbows.

Figure 6:
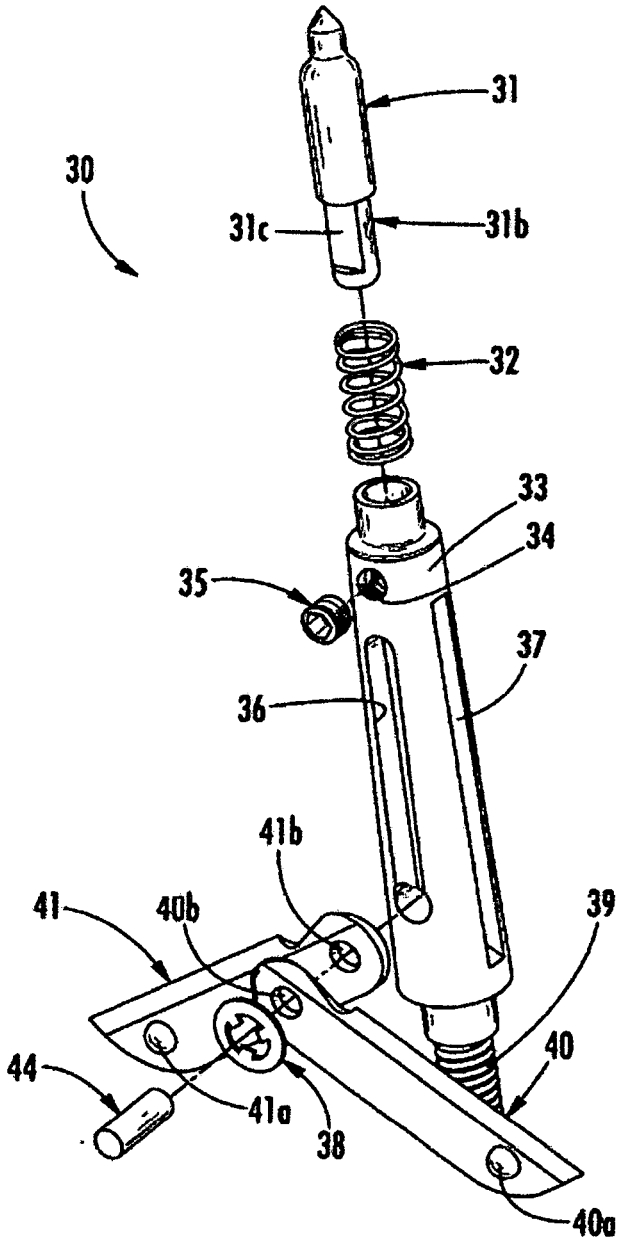
FIG. 6 is an exploded view of the parts of another highly preferred embodiment of the instant invention.

Referring now to FIG. 6 therein is shown an exploded view of the parts of another highly preferred arrowhead 30 of the instant invention similar in many respects to the arrowhead 10 of FIG. 1. Arrowhead 30 includes ferrule 33, tip 31 and tip retraction spring 32. Tip plunger 31*b* is passed through spring 32 into ferrule 33. Set screw 35 retains tip 31 in ferrule by engagement near tip plunger flat portion 31*c*. Blade 40 is inserted into elongated aperture 37 in ferrule 33. Blade 41 is inserted into an elongated aperture (not shown) opposite elongated aperture 37 in ferrule 33 so that pin 44 is passed through aperture 40*b* in blade 40 and aperture 41*b* in blade 41. Then pin 44 is slid up slot 36 in ferrule 33. Detent projection 40*a* on blade 40 and detent projection 41*a* on blade 41 are an interference friction fit in their respective elongated apertures of ferrule 33 and serve to retain blades 40 and 41 in ferrule 33 before arrowhead 30 strikes a game animal or other target. The spring constant of tip retraction spring 12 and the friction of the interference fit of the detent projections 40*a* and 41*a* on blades 40 and 41 are readily confirmed by experiment. For example, if the spring constant of tip retraction spring 12 and the friction of the detent projections are too low, then blades 20 and 21 will deploy in the air upon firing of the arrowhead thereby increasing the aerodynamic drag of the arrowhead. And, if the spring constant of tip retraction spring 12 and the friction of the detent projections are too high, the blades will fail to deploy upon striking the target. High power crossbows typically require stronger springs and higher detent friction while longbows typically require weaker springs and less detent friction of the detent projections. Threaded shank 39 permits arrowhead 30 to be screwed into the shaft of an arrow or into the shaft of a crossbow bolt.

Figure 7:
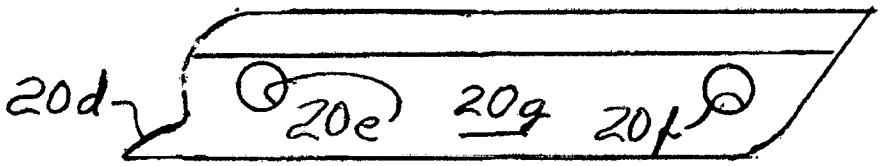
FIGS. 7 and 8 are top views of arrowhead blades comprising spurs.
Figure 8:
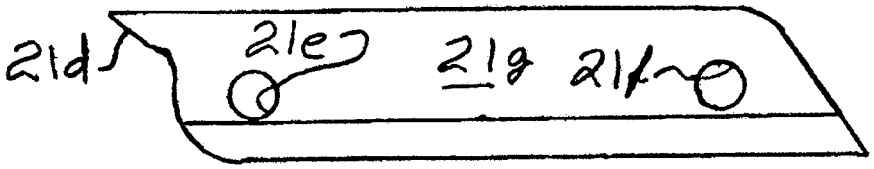
Figure 9:
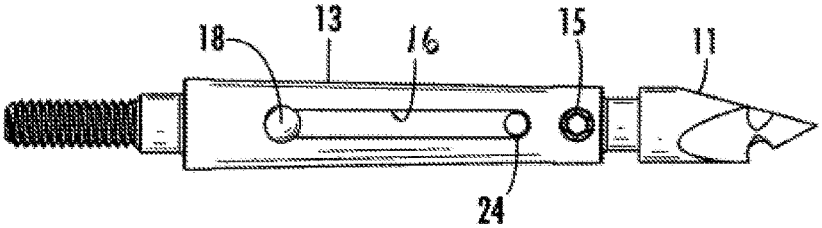
FIG. 9 depicts the arrowhead of FIG. 1 modified to contain the blades of FIGS. 7 and 8.
Figure 10:
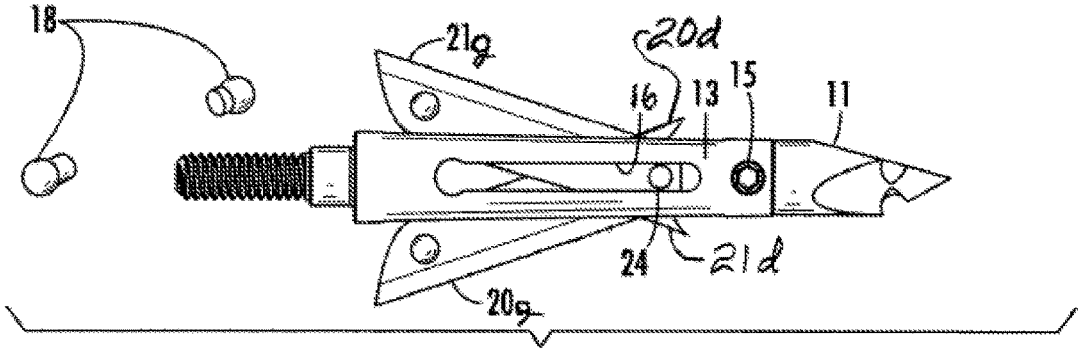
FIG. 10 depicts the arrowhead of FIG. 9 upon impact with a target.
Figure 11:
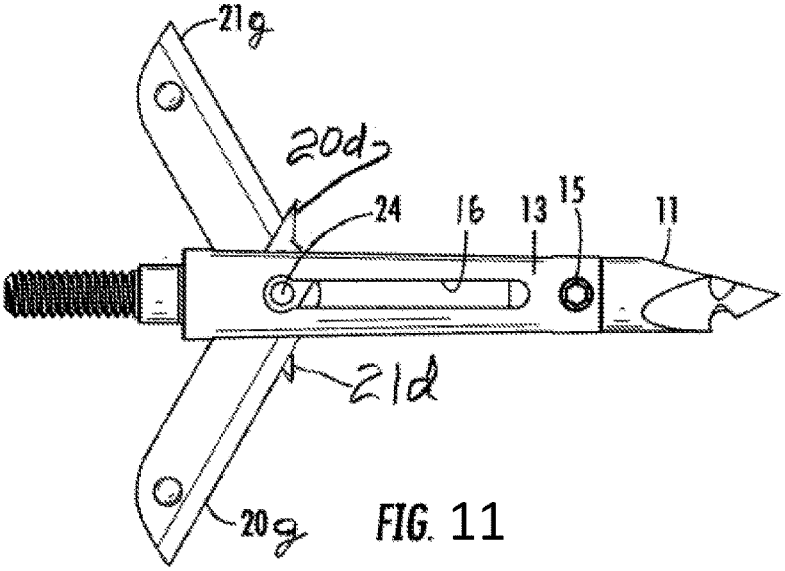
FIG. 11 depicts the blades of the arrowhead of FIG. 9 fully deployed after impact with the target.

Referring now to FIGS. 7 and 8, therein are shown blades 20*g* and 21*g* similar in most respects to blades 20 and 21 of FIG. 1 except the blades 20*g* and 21*g* do not have the notches 20*c* and 21*c* of blades 20 and 21 of FIG. 1 and instead blades 20*g* and 21*g* have spurs 20*d* and 21*d*. Apertures 20*f* and 21*f* in blades 20*g* and 21*g* are adapted to receive hinge pin 24 of FIG. 1. Apertures 20*e* and 21*e* in blades 20*g* and 21*g* are adapted to receive shear pin 18 of FIG. 1. Referring now to FIG. 9, therein is shown the arrowhead of FIG. 1 modified to contain the blades of FIGS. 7 and 8. When arrowhead shown in FIG. 9 strikes a target game animal (such as a deer) tip plunger 11*b* of FIG. 1 is forced into ferrule 13 to force blades 20*g* and 21*g* from ferrule 13 shearing shear pin 18 as pin 24 is slid in the direction away from tip 11 along elongated aperture 16 as shown in FIG. 10. Spur 20*d* in blade 20*g* and spur 21*d* in blade 21*g* tend to snag and engage with the target to better enable blade 20*g* and blade 21*g* to fully deploy as shown in FIG. 11. The reliability of the full extension of the blades of the arrowhead of the instant invention when the arrowhead strikes a game animal is an important benefit of the arrowhead of the instant invention.

Figure 12:
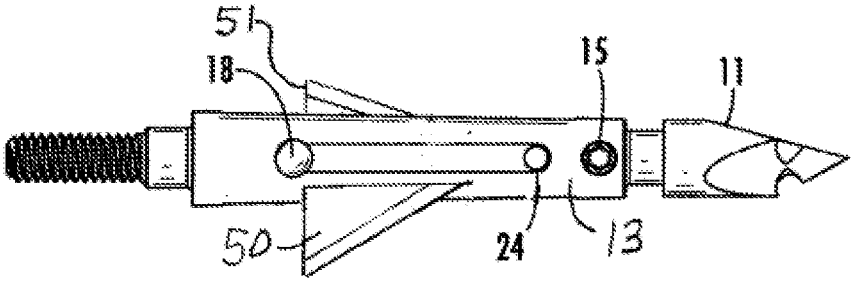
FIG. 12 is a side view of the arrowhead of FIG. 2 comprising additional fixed blades.

Referring now to FIG. 12, therein is shown a side view of the arrowhead of FIG. 2 modified with fixed blades 50 and 51. Although not preferred it should be understood that fixed blades can be attached to any embodiment of the instant invention.

Figure 13:
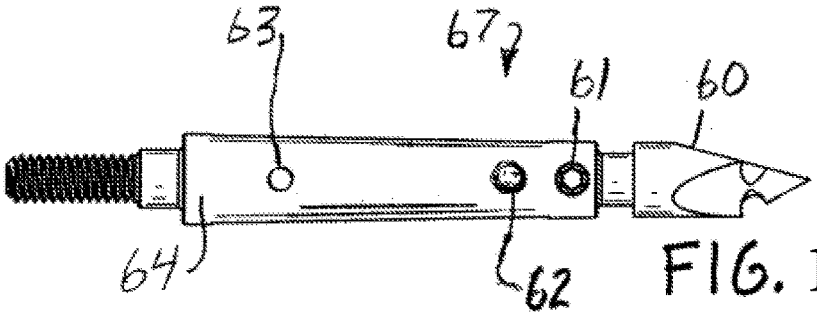
FIG. 13 is a side view of another preferred arrowhead embodiment of the instant invention wherein the blades hinge from the rear of the ferrule of the arrowhead.
Figure 14:
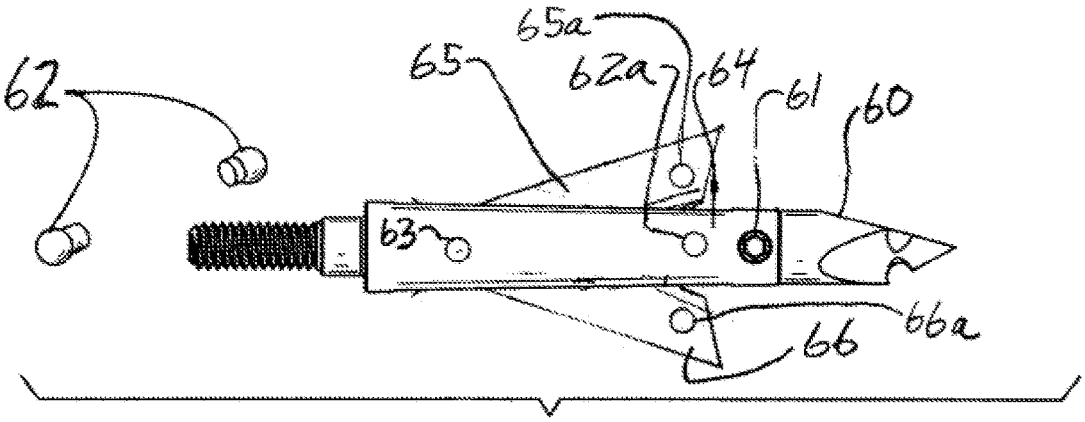
FIG. 14 depicts the arrowhead of FIG. 13 upon impact with a target.
Figure 15:
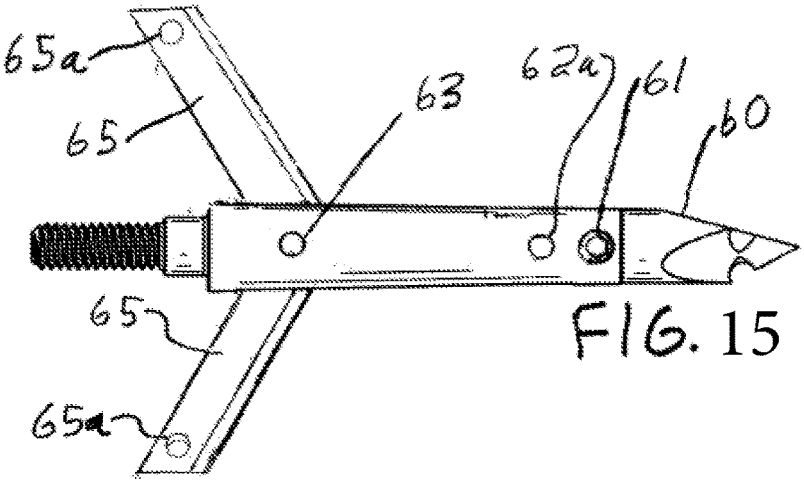
FIG. 15 depicts the blades of the arrowhead of FIG. 13 fully deployed after impact with the target.

Referring now to FIG. 13, therein is shown a side view of another preferred arrowhead embodiment 67 of the instant invention wherein the blades hinge from the rear of ferrule 64 on hinge pin 63. Shear pin 62 is positioned through the front portion of ferrule 64. Tip 60 and set screw 61 are the same as tip 11 and set screw 15 shown in FIG. 1. Ferrule 64 is similar to ferrule 13 shown in FIG. 1 but does not comprise the elongated aperture 16 shown in FIG. 1. Referring now to FIG. 14, when arrowhead 67 of FIG. 13 strikes a target game animal (such as a deer) the tip plunger of tip 60 is forced into ferrule 64 to force blades 65 and 66 from ferrule 64 shearing shear pin 62. FIG. 14 shows bore 62*a* and apertures 65*a* and 66*a* through which shear pin 62 is inserted. Referring now to FIG. 15, therein is shown the blades 65 and 66 of the arrowhead 67 of FIG. 13 fully deployed after impact with the target. An important benefit of the embodiment shown in FIGS. 13-15 is the reliability of the full extension of the blades when the arrowhead strikes a game animal because the blade tips immediately engage with the flesh of the game animal when the shear pin is sheared. If the arrowhead of FIGS. 13-15 is fired into a foam or straw target block so that the arrowhead is buried in the target block, an important benefit of the instant invention is that the arrowhead can be withdrawn from the target block, the blades folding back into the ferrule as the arrow head is withdrawn from the target block. The same benefit is observed if the arrowhead is buried in the flesh of a game animal.

The tip and blades of the instant invention can be made of any suitable material but preferably are made of a metal such as stainless steel. The ferrule of the instant invention can be made of any suitable material but preferably is made of aluminum shaped by automatic machine tools. The shear pin of the instant invention can be made of any suitable material (such as brass, tin or a thermoplastic) but preferably is made of an elastomer such as silicone rubber.

CONCLUSION

While the instant invention has been described above according to its preferred embodiments, it can be modified within the spirit and scope of this disclosure. This application is therefore intended to cover any variations, uses, or adaptations of the instant invention using the general principles disclosed herein. Further, the instant application is intended to cover such departures from the present disclosure as come within the known or customary practice in the art to which this invention pertains.

What is claimed is:

1. A method for expanding the blade of a tip actuated expanding blade arrowhead, the arrowhead comprising a cylindrical ferrule, a tip, at least one blade, a hinge pin; the ferrule having a longitudinal axis, the ferrule having a passageway thereinto along the longitudinal axis of the ferrule, the tip having a shank dimensioned to pass into the passageway, the ferrule having an elongated aperture into said passageway on one side of the ferrule into which the at least one blade is positioned in the ferrule, the at least one blade having a first aperture near one end so that when the arrowhead strikes a game animal the shank of the tip is forced into the ferrule in a direction along the longitudinal axis of the ferrule to force the at least one blade to swing out from the ferrule on the hinge pin, the method characterized by positioning a shear pin through a bore in the ferrule and through a second aperture near the other end of the at least one blade, the axis of the bore being transverse to the longitudinal axis of the passageway into the ferrule, so that the at least one blade is retained in the ferrule before the arrowhead strikes a game animal but that when the arrowhead strikes a game animal the shank of the tip is forced into the ferrule in a direction along the longitudinal axis of the passageway of the ferrule to force the at least one blade to swing out from the ferrule on the hinge pin to shear the shear pin.

2. An arrowhead comprising: (a) a cylindrical ferrule; (b) a tip; (c) a first blade; (d) a second blade; (e) a hinge pin; and (d) a shear pin, the ferrule having a longitudinal axis, the ferrule having a passageway thereinto along the longitudinal axis of the ferrule, the tip having a shank dimensioned to pass into the passageway, the ferrule having a first elongated aperture into said passageway on one side of the ferrule into which the first blade is positioned within the ferrule, the ferrule having a second elongated aperture into said passageway on the other side of the ferrule into which the second blade is positioned within the ferrule, the first blade having a first aperture near one end and a second aperture near the other end, the second blade having a first aperture near one end and a second aperture near the other end, the hinge pin positioned through the first aperture of the first and second blades, the hinge pin positioned through and transverse to the longitudinal axis of the ferrule, the ferrule having a bore therethrough transverse to the longitudinal axis of the ferrule, the shear pin positioned through said bore and through the second apertures of the first and second blades so that when the arrowhead strikes a game animal the shank of the tip pushes the blades to move in a direction away from the longitudinal axis of the ferrule to shear the shear pin and swing out from the ferrule nn the hinge pin.

3. The arrowhead of claim 2, wherein the tip terminates at the point of a pyramid with the edges of the faces of the pyramid being notched.

4. The arrowhead of claim 3, wherein the notches are cylindrical in shape and transverse to the longitudinal axis of the ferrule.

5. The arrowhead of claim 3, wherein the pyramid has three faces and wherein the notches are cylindrical in shape and transverse to the longitudinal axis of the ferrule.

6. The arrowhead of claim 5, wherein the shear pin is made of an elastomer.

7. The arrowhead of claim 2, wherein the shear pin is made of an elastomer.

* * * * *